US011793294B2

(12) United States Patent
Niemeyer et al.

(10) Patent No.: US 11,793,294 B2
(45) Date of Patent: Oct. 24, 2023

(54) DEVICE FOR DISCHARGING A SUBSTANCE

(71) Applicant: RPC Bramlage GmbH, Lohne (DE)

(72) Inventors: Jessica Niemeyer, Lohne (DE); Lea Hammersen, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 64 days.

(21) Appl. No.: 17/622,894

(22) PCT Filed: Jun. 26, 2020

(86) PCT No.: PCT/EP2020/068031
§ 371 (c)(1),
(2) Date: Dec. 27, 2021

(87) PCT Pub. No.: WO2020/260586
PCT Pub. Date: Dec. 30, 2020

(65) Prior Publication Data

US 2022/0354237 A1 Nov. 10, 2022

(30) Foreign Application Priority Data

Jun. 28, 2019 (GB) ..... 1909373
Nov. 12, 2019 (GB) ..... 1916448

(51) Int. Cl.
*A45D 40/04* (2006.01)
*A45D 40/02* (2006.01)
*B65D 83/00* (2006.01)

(52) U.S. Cl.
CPC ..... *A45D 40/04* (2013.01); *A45D 40/02* (2013.01); *B65D 83/0011* (2013.01)

(58) Field of Classification Search
CPC ..... A45D 40/04; A45D 40/02; A45D 40/20; A45D 2040/208; B65D 83/0005; B65D 83/0011
(Continued)

(56) References Cited

U.S. PATENT DOCUMENTS 3,907,441 A 9/1975 Idec et al.
4,915,528 A 4/1990 Seager
(Continued)

FOREIGN PATENT DOCUMENTS

DE 695 34 260 T2 3/2006
EP 0 488 866 A1 6/1992
(Continued)

OTHER PUBLICATIONS

International Search Report of PCT/EP2020/068031, dated Dec. 1, 2020.

*Primary Examiner* — David J Walczak
(74) *Attorney, Agent, or Firm* — Collard & Roe, P.C.

(57) ABSTRACT

A device for discharging a substance has a device housing equipped with a movable support in order to act on the substance, and a rotary handle for moving the support between a lower starting position and an upper extended position of the support. The rotary handle forms a spindle part together with a spindle. The spindle part passes through a housing base, and is locked to the housing base and is sealed. A locking protrusion engages into a locking recess of the spindle part, and a seal protrusion sealingly rests against a circumferential surface of the spindle part. The locking recess of the spindle part is formed axially below the circumferential surface which interacts with the seal protrusion. The seal protrusion is formed on a sleeve section of the device housing, and a sleeve section seal edge is sealingly surrounded by the spindle part in a U-shaped manner.

13 Claims, 13 Drawing Sheets

(58) Field of Classification Search
USPC ..... 401/75, 171–175
See application file for complete search history.

(56) References Cited

U.S. PATENT DOCUMENTS

| | | | | |
|---|---|---|---|---|
| 5,181,790 | A | 1/1993 | Lucas | |
| 5,868,510 | A * | 2/1999 | Lacout | A45D 40/04 401/175 |
| 8,297,867 | B2 * | 10/2012 | Nasu | A45D 40/04 401/175 |
| 8,961,048 | B2 * | 2/2015 | Baines | B65D 83/0011 401/175 |
| 10,315,832 | B2 | 6/2019 | Ellsworth et al. | |

FOREIGN PATENT DOCUMENTS

| | | | |
|---|---|---|---|
| EP | 0 713 660 | B1 | 6/2005 |
| WO | 2010/072669 | A1 | 7/2010 |

* cited by examiner

DEVICE FOR DISCHARGING A SUBSTANCE

CROSS REFERENCE TO RELATED APPLICATIONS

This application is the National Stage of PCT/EP2020/068031 filed on Jun. 26, 2020, which claims priority under 35 U.S.C. § 119 of British Application No. 1909373.1 filed on Jun. 28, 2019 and British Application No. 1916448.2 filed on Nov. 12, 2019, the disclosures of which are incorporated by reference. The international application under PCT article 21(2) was not published in English.

AREA OF TECHNOLOGY

The invention initially relates to a device for discharging a substance, wherein a movable support is arranged in a device housing to act on the substance, wherein a rotary handle is further designed to move the support between a lower starting position and an upper extended position of the support, and forms a spindle part with a spindle that can be rotated around a longitudinal axis provided in the movement direction of the support, wherein the spindle part passes through a housing base, and is locked and sealed to the housing base, wherein a locking protrusion of the housing base further engages into a locking recess of the spindle part, and a seal protrusion running from the housing base abuts tightly against a circumferential surface of the spindle part, and wherein the rotary handle of the spindle part is additionally formed on the lower face of the device housing, wherein, viewed from the rotary handle, the locking recess of the spindle part is formed axially below the circumferential surface that interacts with the seal protrusion, wherein the seal protrusion further has a sleeve-like design, with a taper that arises at least partially axially upwardly in cross section, wherein the taper runs at least partially like a cone, wherein a counter-locking protrusion is formed on the spindle part, and conically expands from axially above to axially below in cross section, wherein a control slant of the counter-locking protrusion further transitions axially upward into a circumferential surface of the spindle part or the sleeve that runs concentrically to the longitudinal axis x, wherein a housing-side seal protrusion abuts against this circumferential surface, which is molded onto the upper face of the housing base, and surrounds the counter-locking protrusion of the spindle part with a foot section that runs concentrically to the longitudinal axis x, wherein a radially outer facing front surface (35) of the counter-locking protrusion (32) is formed on a radius (c), which is selected to be larger than a radius (a) of an inwardly directed closing surface (30) of the locking protrusion (28).

The invention further relates to a device for discharging a substance, wherein a movable support is arranged in a device housing to act on the substance, wherein a rotary handle is further designed to move the support between a lower starting position and an upper extended position of the support, and forms a spindle part with a spindle that can be rotated around a longitudinal axis provided in the movement direction of the support, wherein the spindle part passes through a housing base, and is locked and sealed to the housing base, wherein a locking protrusion of the housing base further engages into a locking recess of the spindle part, and a seal protrusion running from the housing base abuts tightly against a circumferential surface of the spindle part, and wherein the rotary handle of the spindle part is additionally formed on the lower face of the device housing, wherein the locking recess of the spindle part is formed axially below the circumferential surface that interacts with the seal protrusion as viewed from the rotary handle.

The invention relates to a device for discharging a substance, wherein a movable support is arranged in a device housing to act on the substance, wherein a rotary handle is further designed to move the support between a lower starting position and an upper extended position of the support, and forms a spindle part with a spindle that can be rotated around a longitudinal axis provided in the movement direction of the support, wherein the spindle part passes through a housing base, and is locked and sealed to the housing base, wherein a locking protrusion of the housing base further engages into a locking recess of the spindle part, and a seal protrusion running from the housing base abuts tightly against a circumferential surface of the spindle part, and wherein the rotary handle of the spindle part is additionally formed on the lower face of the device housing.

PRIOR ART

For example, devices of the kind in question are known from the area of cosmetics. For example, such a device can be designed as a kind of deodorant stick, with a preferably solid substance, which while resting on the support of the device in the device housing can be moved via the spindle formation using the rotary handle into a protruding position that arises opposite an opening of the device housing. A use of the device is enabled in particular in this protruding position. Relocating the spindle makes it possible to move the substance into a nonuse position that is retracted in the direction toward the lower starting position of the support.

The spindle part is rotatably locked to the housing base, and sealed relative to the latter, which is preferably intended to produce as gastight a seal as possible of the housing interior surrounding the substance relative to the environment.

For example, reference is made to U.S. Pat. No. 10,315,832 B2 in this conjunction with regard to prior art.

In a device known from U.S. Pat. No. 4,915,528 A, proceeding from a first slanted section that abuts directly against the counter-locking protrusion and passes over into an additional slanted section by way of a stepped section, the seal protrusion is formed in the area of the stepped section, accompanied by the expansion of the respective section as a whole.

Further known from WO 2010/072669 A1 is a device in which the spindle is plug-connected with the rotary handle. In addition, the spindle is only guided by the support part being moved through the spindle.

In a device known from U.S. Pat. No. 3,907,441 A, only a seal section of the sleeve section interacts with the spindle. This does not directly result in a necessary, reliable seal.

With respect to prior art, further reference is made to EP 713660 B1 (DE 695 34 260 T2) and EP 488 866 B1.

SUMMARY OF THE INVENTION

Proceeding from the described prior art, the invention deals with the object of indicating a device for discharging a substance, which is advantageously designed in terms of sealing and mounting capability.

This object is initially achieved by a device for discharging a substance comprising a device housing (3), a movable support (7) arranged in the device housing (3) and being configured to act on the substance (2), a rotary handle (4) configured to move the support (7) between a lower starting position and an upper extended position of the support (7), the rotary handle (4) being formed on a spindle part (15) with a spindle (14) that is configured to be rotated around a longitudinal axis (x) provided in a movement direction of the support (7), wherein the spindle part (15) passes through a housing base (16), and is locked and sealed to the housing base (16), wherein a locking protrusion (28) of the housing base (16) further engages into a locking recess (29) of the spindle part (15), and a seal protrusion (37) running from the housing base (16) abuts tightly against a circumferential surface (36) of the spindle part (15), and wherein the rotary handle (4) of the spindle part (15) is additionally formed on a lower face of the device housing (3), wherein, viewed from the rotary handle (4), the locking recess (29) of the spindle part (15) is formed axially below a circumferential surface (36) that interacts with the seal protrusion (37), wherein the seal protrusion (37) further has a sleeve-like design, with a taper (38) that arises at least partially axially upwardly in cross section, and wherein the taper (38) runs at least partially like a cone. Emphasis is placed on the foot section surrounding the counter-locking protrusion at a distance, on the tapering section extending from the foot section and bending axially upward and radially inward, on a radially inner seal surface of the seal protrusion coming to tightly abut against the circumferential surface of the spindle part on the end side of the tapering section, and on the seal protrusion being designed like a lip in cross section, wherein the seal surface (40) is here arranged on a radius (b) that is selected to be smaller than the radius (a) of the closing surface (30) of the locking protrusion (28), which is also selected to be smaller than the radius (c) of the front surface (35) of the counter-locking protrusion (32).

This object is further achieved in a device for discharging a substance, wherein emphasis is placed on the spindle and the rotary handle having a two-part design, and, during the assembly of the device, being connected with each other in a torsionally rigid manner, on the housing base, surrounding its base opening, forming a sleeve section in the housing interior that is directed axially upward and concentrically to the longitudinal axis x, as viewed correspondingly from the rotary handle, on the sleeve section overlapping a housing base-side sleeve in an axial direction, and forming a guide for the spindle designed concentric to the longitudinal axis x on the lower face spaced axially apart from the plug-in receptacle for an end area of the spindle, wherein the guide engages with radially inwardly directed locking protrusions into a circumferential groove of the spindle forming a locking recess in the area of the downwardly facing end of the guide.

This object is further achieved in a device for discharging a substance, wherein emphasis is placed on the seal protrusion being formed on a sleeve section of the device housing, on a seal edge of the sleeve section that is free on the lower face in any case being tightly surrounded by the spindle part on the interior in a U-shaped manner, on the U-shaped enclosure having two U-legs, of which the one U-leg runs radially inward to the seal edge, and the other U-leg runs radially outward to the seal edge, and on the radially outer running U-leg at the same time forming the locking recess.

The proposed solution initially results in a favorable and effective seal. Viewed in the axial direction, the sealing area is formed between the locking area between the spindle part and device housing that allows a rotation of the spindle and the substance carried by the support inside of the device housing, corresponding to axially above the locking area and axially below the substance. This further results in a preferably, at any rate essentially, gastight seal of the substance area relative to the locking area between the spindle part and the device housing.

According to the further solution, the sleeve section of the device housing comprises a foot-sided end section of the spindle part, in particular one facing the rotary handle, and can accordingly acts in a guiding or centered manner on the spindle part, in particular during a rotation of the spindle part via the rotary handle. In addition, the sleeve section can possibly also define a lower starting position of the support, for example by forming a stop.

The seal protrusion is formed in the area of a circumferential edge area of the sleeve section that preferably faces downward in the normal use state, wherein the edge area forms a seal edge that faces downward and/or radially outward and/or inward. In a preferred configuration, the seal protrusion or the edge area of the sleeve section that forms the latter here acts tightly together with the spindle part in the circumferential direction, wherein there can further be a circumferential seal surface that here arises in relation to the sleeve section along the radially outer circumferential sleeve surface and/or along the radially inner circumferential sleeve surface and/or results from the axially downward facing front surface.

By giving the portion of the spindle part that interacts with the edge area of the sleeve section a U-shaped configuration in a cross section in which the longitudinal axis appears as a line, a combined seal arises both radially outward and radially inward, and possibly also in the area of the downwardly facing seal edge of the sleeve section.

The locking protrusion can have a radially inner closing surface, and the seal protrusion can have a radially inner seal surface. According to a preferred embodiment, the seal surface can here—with reference to the longitudinal axis—be formed on the same or smaller radius as the closing surface. In a cross section through the device, there correspondingly arises a preferred arrangement of the seal surface with at most the same, and preferably a smaller, distance dimension to the longitudinal axis viewed transverse to the longitudinal axis by comparison to the arrangement of the locking protrusion-side closing surface.

For example, such a distance dimension, for example a radial dimension, of the inner seal surface to the longitudinal axis can correspond to about 0.8 to 1 times, further for example to 0.9 to 0.98 times, the related distance dimension of the inner closing surface to the longitudinal axis.

The seal protrusion as a whole is sleeve-shaped, with a taper arising at least partially toward the top in cross section. This yields an overall funnel-shaped design of the seal protrusion.

The taper can here further proceed at least partially like a cone.

A seal that acts circumferentially, possibly resiliently against the facing circumferential surface of the spindle part can arise in the normal use position utilizing such a funnel or sleeve shape. In an unloaded position, i.e., before penetrating through the opening with the spindle part, the opening that arises in the tapering area of the sleeve-like seal protrusion for the passage of the spindle part can have an opening dimension, in particular diameter dimension, selected to be smaller than the corresponding diameter dimension in the area of the corresponding circumferential surface of the spindle part in the use state. With the assembly of the spindle part and its corresponding passage through the opening of the seal protrusion, it is preferably elastically expanded to the necessary diameter dimension, accompanied by a corresponding tight abutment of the seal protrusion in the area of its opening edge.

In another configuration, a counter-locking protrusion can be formed on the spindle part, and conically expand in cross section from axially above to axially below. The conical expansion can provide an assembly aid for assembling the spindle part in the device housing, for example in the form of a control slant to allow the housing-side locking protrusion to run over. The counter-locking protrusion can here further axially limit the spindle part-side locking recess.

In the assembly and use position, the counter-locking protrusion preferably extends in an axial area between the housing-side locking protrusion and the seal protrusion, so that the counter-locking protrusion is also overlapped by the seal protrusion. As a whole, this can further result in an arrangement in which the counter-locking protrusion of the spindle part is quasi-sheathed by the seal protrusion provided axially above and the locking protrusion of the housing provided axially below.

According to one possible configuration, the U-shaped enclosure of the free seal edge of the housing-side sleeve section described above can have two U-legs, of which the one U-leg runs radially inward to the seal edge, and the other U-leg runs radially outward to the seal edge. A U-web that connects the two U-legs, in particular that runs in a plane transverse to the longitudinal axis, can here underpin the seal edge in another configuration. An additional seal surface can here arise between the seal edge and the U-web, as further preferred also or alternatively between the radially inner U-leg and the sleeve section and/or the radially outer U-leg and the sleeve section.

According to a possible configuration, the radially outer running U-leg can at the same time form the locking recess of the spindle part, for purposes of locking interaction with the housing-side locking protrusion in the area of the sleeve section. For example, the locking protrusion, just as the seal edge, can be formed at the end of the sleeve section, further for example in a radially outer circumferential end area of the sleeve section.

With respect to the longitudinal axis, the seal edge of the sleeve section can also run on a radius that can correspond to one third or less of a largest inner diameter or largest inner extension dimension of the device housing as viewed in cross section transverse to the longitudinal axis. For example, the radius of the seal edge can correspond to about 0.2 to 0.6 times, further for example to about 0.35 to 0.4 times, the largest inner extension dimension of the device housing as viewed transverse to the longitudinal axis.

In another configuration, the spindle part can at the same time integrally form a lower base that covers an entire lower surface. For example, this spindle part base can be formed by a rotary handle, and according to a preferred configuration, completely axially cover a facing housing base, at least in a predetermined rotational direction of the spindle part, in particular of the rotary handle. In a rotational position of the spindle part or the rotary handle that deviates from the predetermined rotational direction, at least one partially axial coverage can arise relative to the housing base, in particular to the immediate surrounding area of the sleeve part.

The spindle part can have a counter-locking protrusion, which can be formed axially above the radially inner U-leg of the enclosure. The counter-locking protrusion is correspondingly preferably arranged between the sealing area and the substance area as viewed in an axial direction, wherein, in another preferred configuration, the seal between the spindle part and housing base or sleeve section is formed completely below the field of action of the counter-locking protrusion as viewed in the axial direction.

According to a possible embodiment, the spindle and rotary handle can form the spindle part as a whole in an integral, and further preferably a materially uniform, manner. The rotary handle and spindle can alternatively also be designed separately. For example, a rotationally fixed plug-in assignment during assembly of the device yields the spindle part comprised of the rotary handle and spindle.

In order to maintain a stable rotational position, the rotary handle or the spindle part can interact with the housing base in a locking, yet overrunable manner. The prescribed locking position—or the plurality of locking positions—makes it possible to predefine and lock at least one, preferably several, for example two, defined rotational base positions of the rotary handle relative to the device housing. This kind of configuration can be advantageous in particular given a device with a noncircular layout design, in which the device housing and the rotary handle have the same layout contours. For example, the defined lock of the rotary handle can be provided in cases where the rotary handle and device housing have an alignment with preferably the same contour. In addition, this makes it possible for identical rotational angles of the rotary handle to arise between two sequential rotational locking positions in a rotational direction, along with correspondingly large linear displacement paths of the support carrying the substance.

Housing-side locking formations and rotary handle-side counter-locking formations can further be provided for this purpose. In the respective rotational base position, the locking formations enter into a locking position with the counter-locking formations, which the user can run over, preferably in a deliberate manner.

The rotary handle can be supported in terms of area on an undersurface of the housing base, at least in a radially inner area relative to the locking formation, wherein such a supporting area is preferably provided so as to be completely circumferential concentrically to the longitudinal axis.

As an alternative to or, as preferred, in combination with a radially inner support, a further configuration can provide a circularly circumferential area radially outside of a locking formation, in which the housing base and the rotary handle can directly abut against each other. A comparatively extensive support can correspondingly arise.

For example, a locking formation and a counter-locking formation can further each have a circular layout, wherein the one formation is designed as a cup-shaped depression, into which the other formation can drop in a locking manner as a kind of adjusted elevation.

In a preferred configuration, two locking formations are provided on the undersurface of the housing base, and two counter-locking formations are provided on the handle, so that two defined rotational base positions can arise in the rotational direction of the rotary handle.

Both the locking formations and the counter-locking formations can here each be arranged diametrically opposite each other in relation to the longitudinal axis.

In terms of the disclosure, the areas or value ranges or multiple ranges indicated above and below also include all intermediate values, in particular in 1/10 increments of the respective dimension, possibly also dimensionless. For example, the indication 0.2 to 0.6 times also includes the disclosure of 0.3 to 0.6 times, 0.2 to 0.5 times, 0.3 to 0.5 times, etc. This disclosure can serve on the one hand to limit a specified boundary from below and/or above, but alternatively or additionally to disclose one or several singular values out of a respectively indicated range.

BRIEF DESCRIPTION OF THE DRAWINGS

While the invention is explained below based on the attached drawing, the latter only shows exemplary embodiments. Therefore, a part that is described only in relation to one of the exemplary embodiments and not replaced by a different part in a further exemplary embodiment based on the characteristic highlighted therein is also described for this further exemplary embodiment as a part that is at least possibly present. The drawing shows.

DESCRIPTION OF THE EMBODIMENTS

Figure 1:
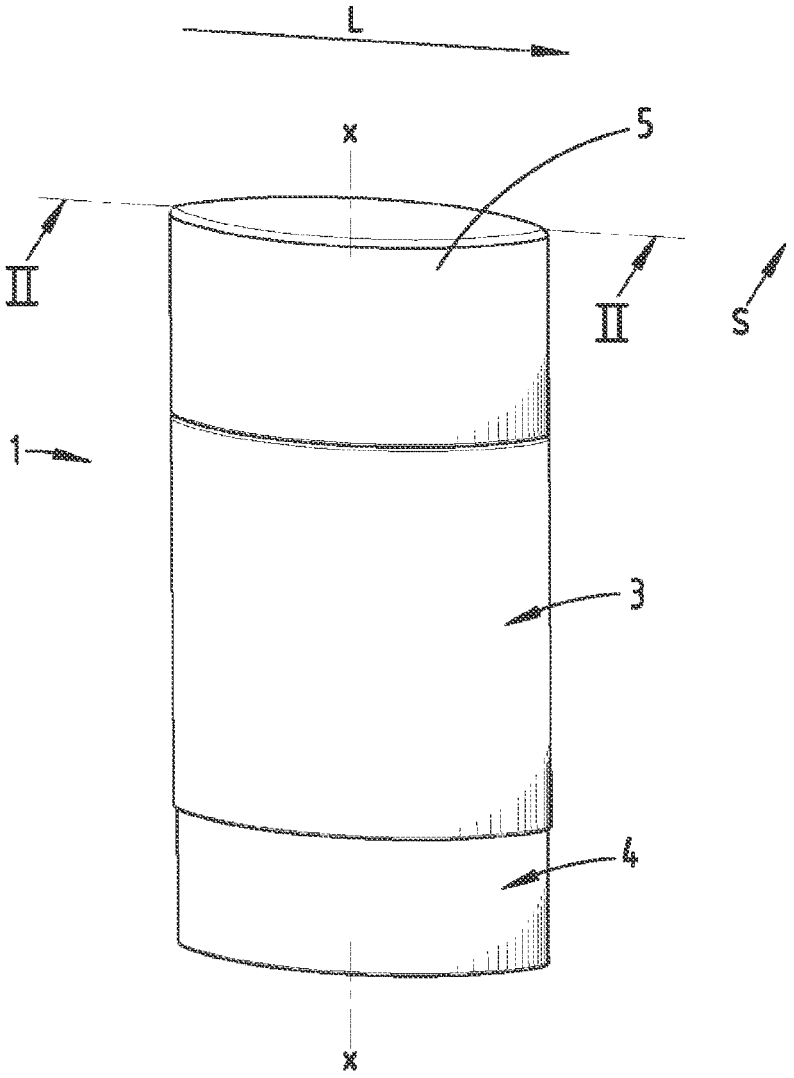
FIG. 1 a perspective illustration of a device for discharging a substance.

Shown and described is a device 1 for discharging a substance 2, for example as a kind of deodorant stick.

In particular, the device 1 further has a device housing 3 and a rotary handle 4.

The overall preferably solid and stable substance 2 rests on a movable support 7 in the device housing 3, directly surrounded by a housing wall 6 of the device housing 3. In the unused state, the substance 2 located on the support 7 can be covered by a cover cap 5.

Figure 2:
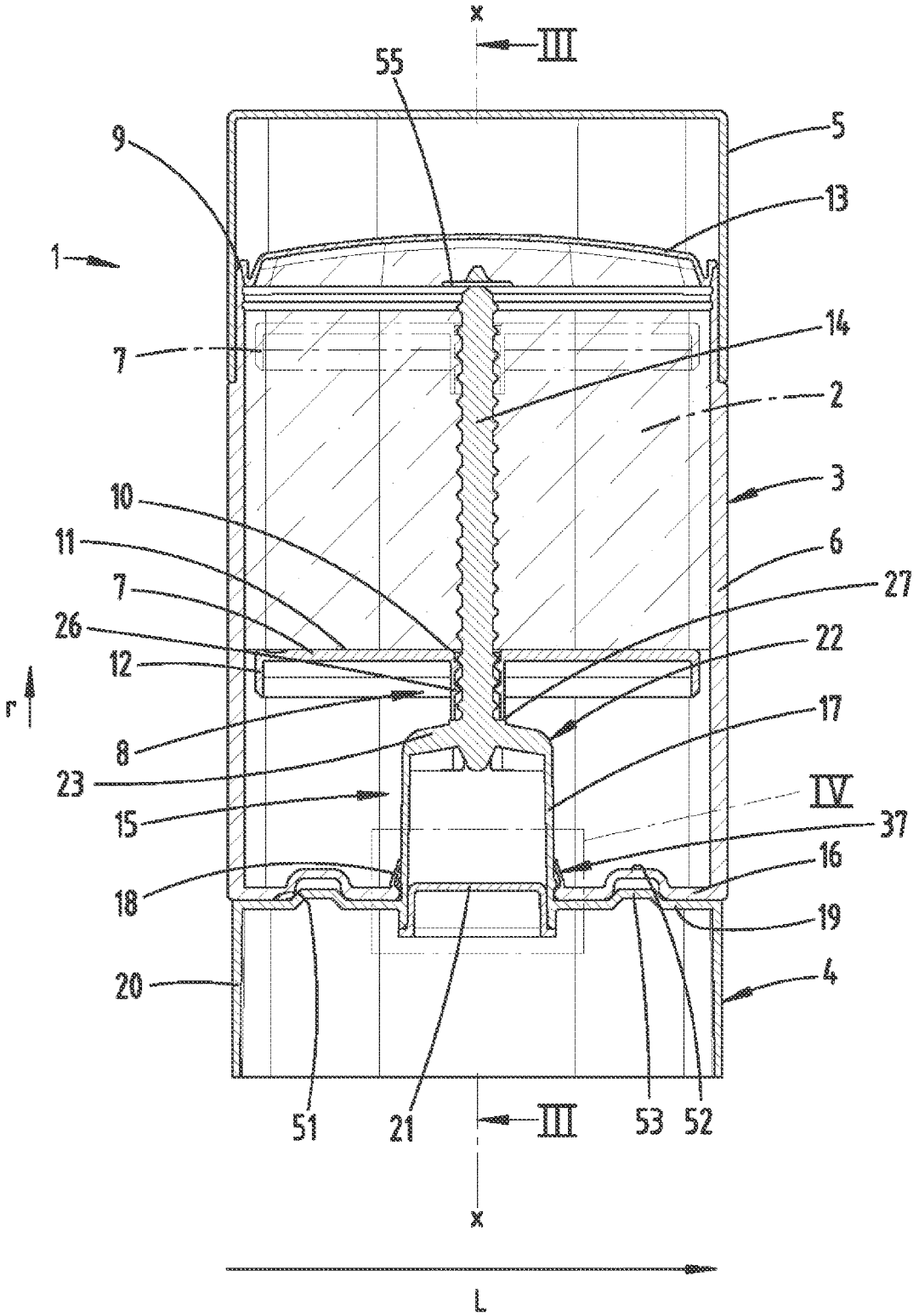
FIG. 2 the section according to line II-II on FIG. 1 through a device in a first embodiment.
Figure 3:
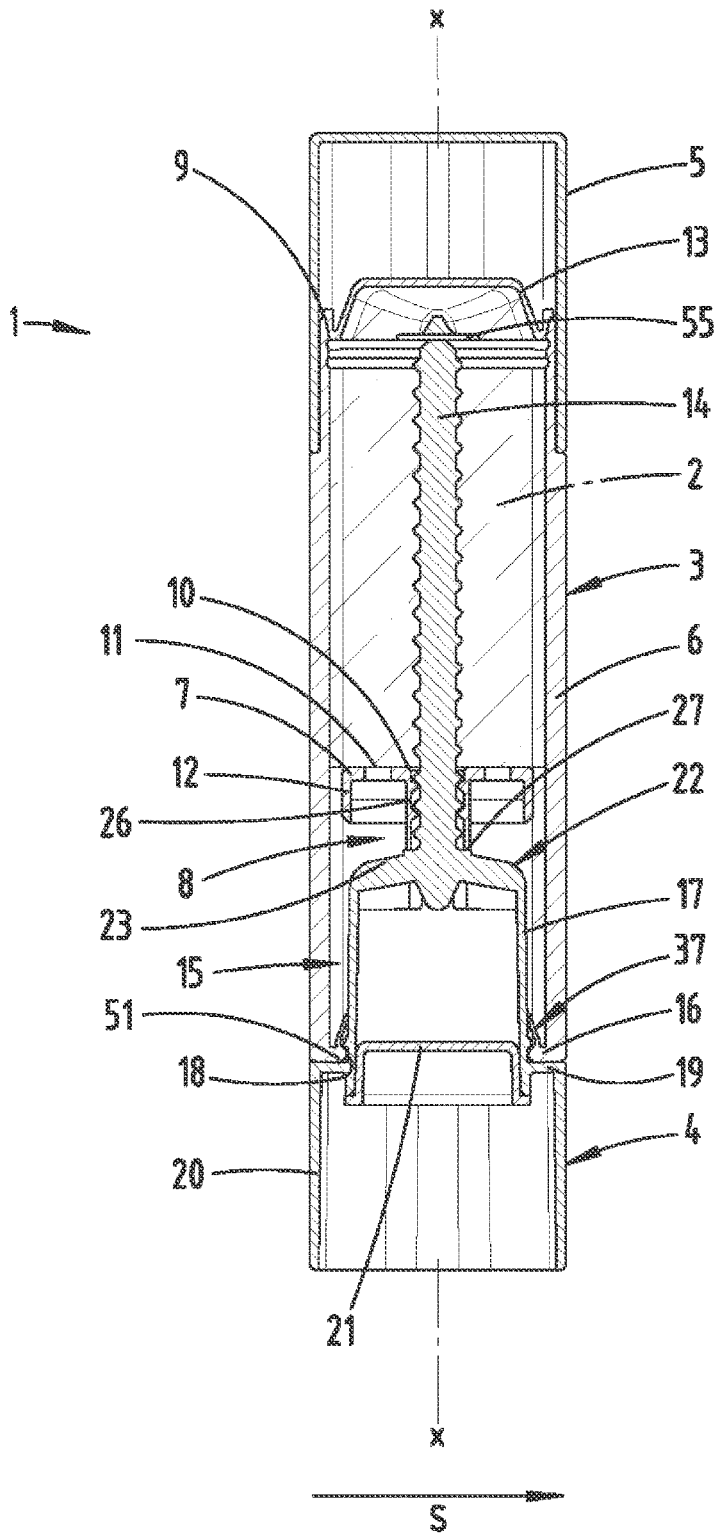
FIG. 3 the section according to line III-III on FIG. 2.
Figure 4:
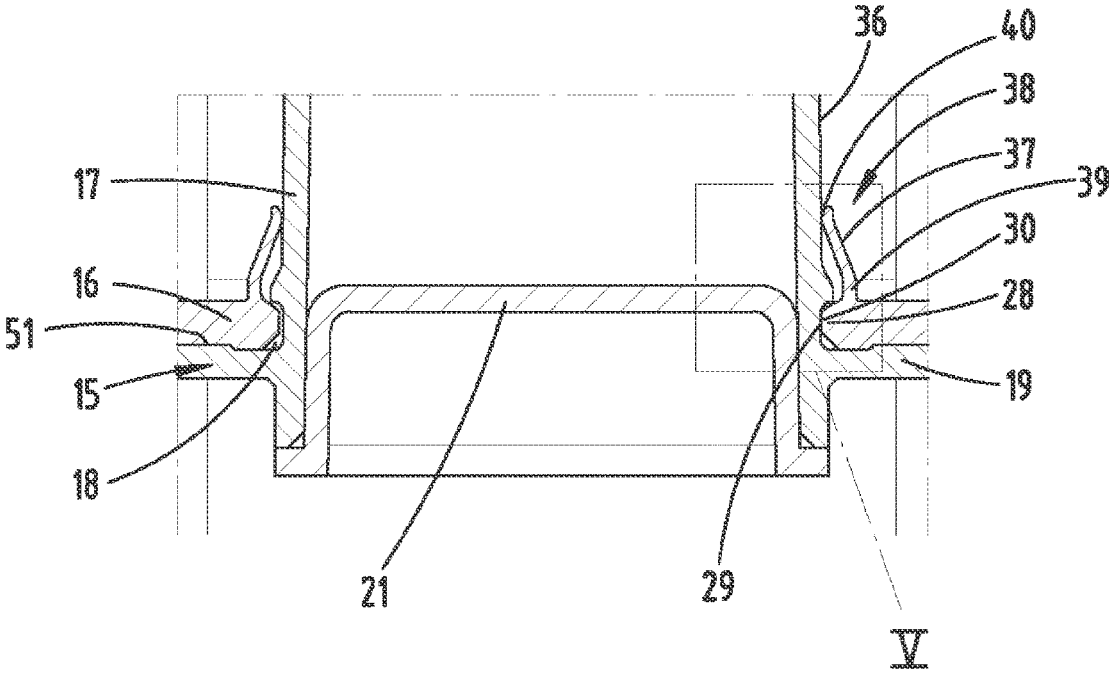
FIG. 4 the magnification of area IV on FIG. 2.
Figure 8:
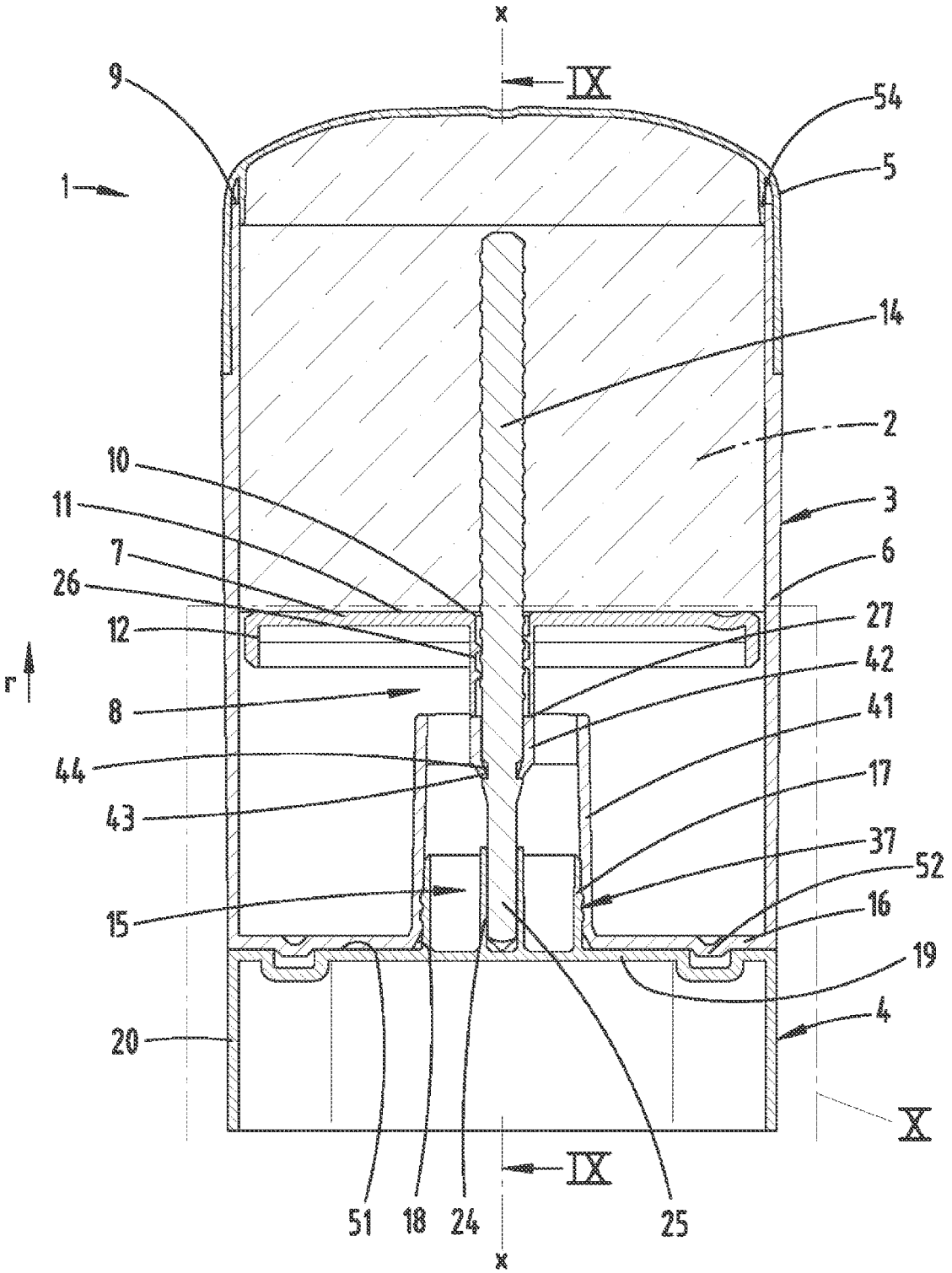
FIG. 8 a sectional view according to FIG. 2 of the device in a second embodiment.
Figure 9:
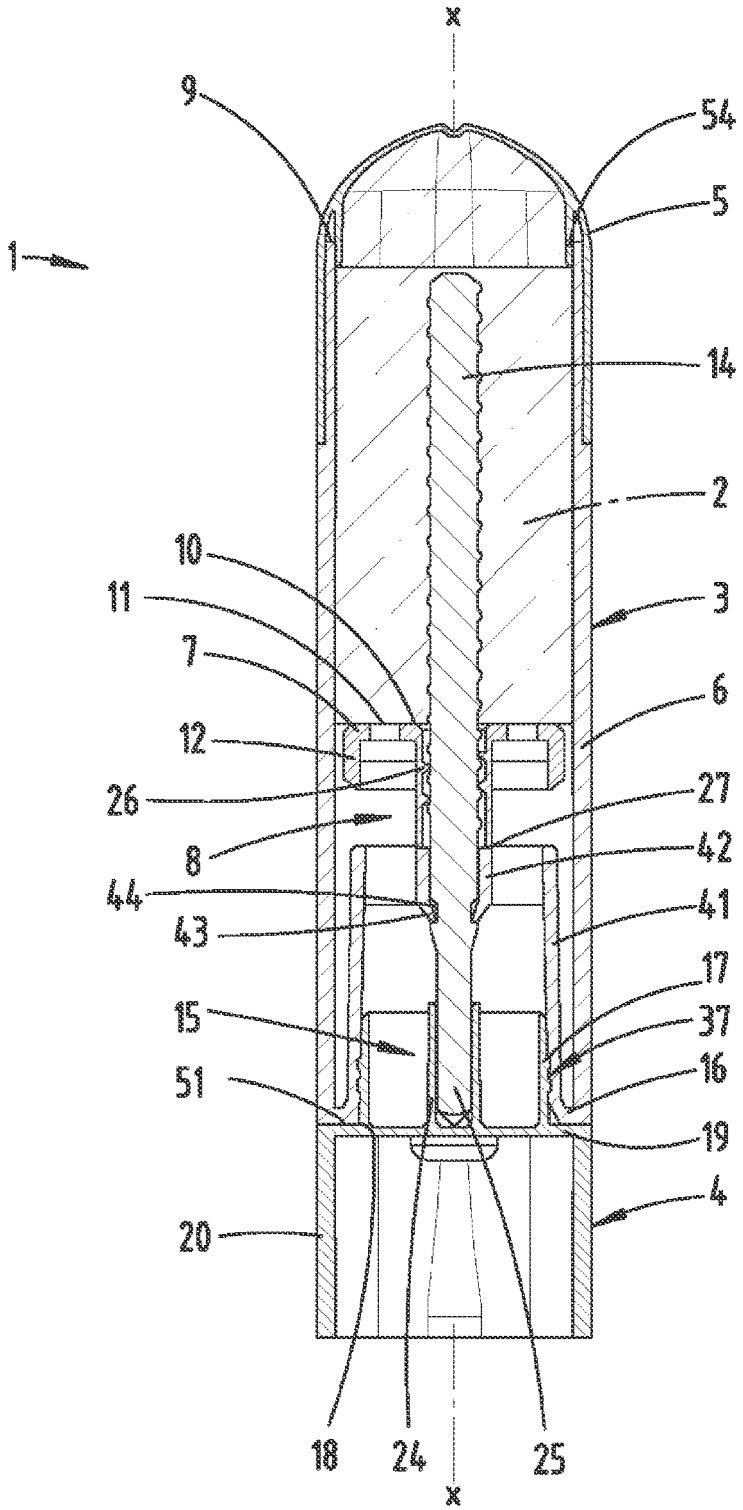
FIG. 9 the section according to line IX-IX on FIG. 8.

The support 7 can be moved by way of a movement unit 8 along a longitudinal axis x, which preferably forms a central longitudinal body axis of the device 1 at the same time, between a lowermost starting position, for example as shown on FIGS. 2 and 3, but beyond that, for example, also on FIGS. 8 and 9 as well as 12 and 13, and an upper extended position. In the illustration according to FIG. 2 (first embodiment of device 1), this extended position is denoted by dot-dashed lines.

The upper extended position can involve a maximum upper extended position. The support 7 can here come to abut against a stop 55 preferably designed as a radially protruding circular disk, allocated to an upper end of the spindle 14.

As a whole, the device housing 3 essentially determines the shape of the device 1, wherein, with reference to a layout in which the longitudinal axis x appears as a point in said layout, the device 1 and in particular the device housing 3 can have an oval outer contour, with a longitudinal extension direction L and a narrow extension direction S viewed transversely thereto.

In the covering position (e.g., see FIG. 2), the cover cap 5 overlaps a housing opening 9 that is centrally passed through by the longitudinal axis x, and through which the substance 2 can be moved into a usable protruding position via the movement unit 8 after removing the cover cap 5.

The support 7 preferably has a contour that is peripherally adjusted to the progression of the interior side of the circumferential housing wall 6. The support 7 that can be moved like a piston in a traveling direction r along the longitudinal axis x can here in particular have a closed central area 10. In addition, the surface 11 that faces the substance 2 and against which the substance 2 is supported in the device 1 can be completely closed in design. A circumferential wall 12 of the support 7 can abut against the facing interior surface of the housing wall 6 as a kind of lip.

With the possible exception of the central area 10, an at least partially open support 7 can be provided in an alternative configuration, for example which can be used to fill the device 1 with substance 2. For example, this type of filling can take place in an overhead position of the device 1 provided with a cover cap 5.

Figure 12:
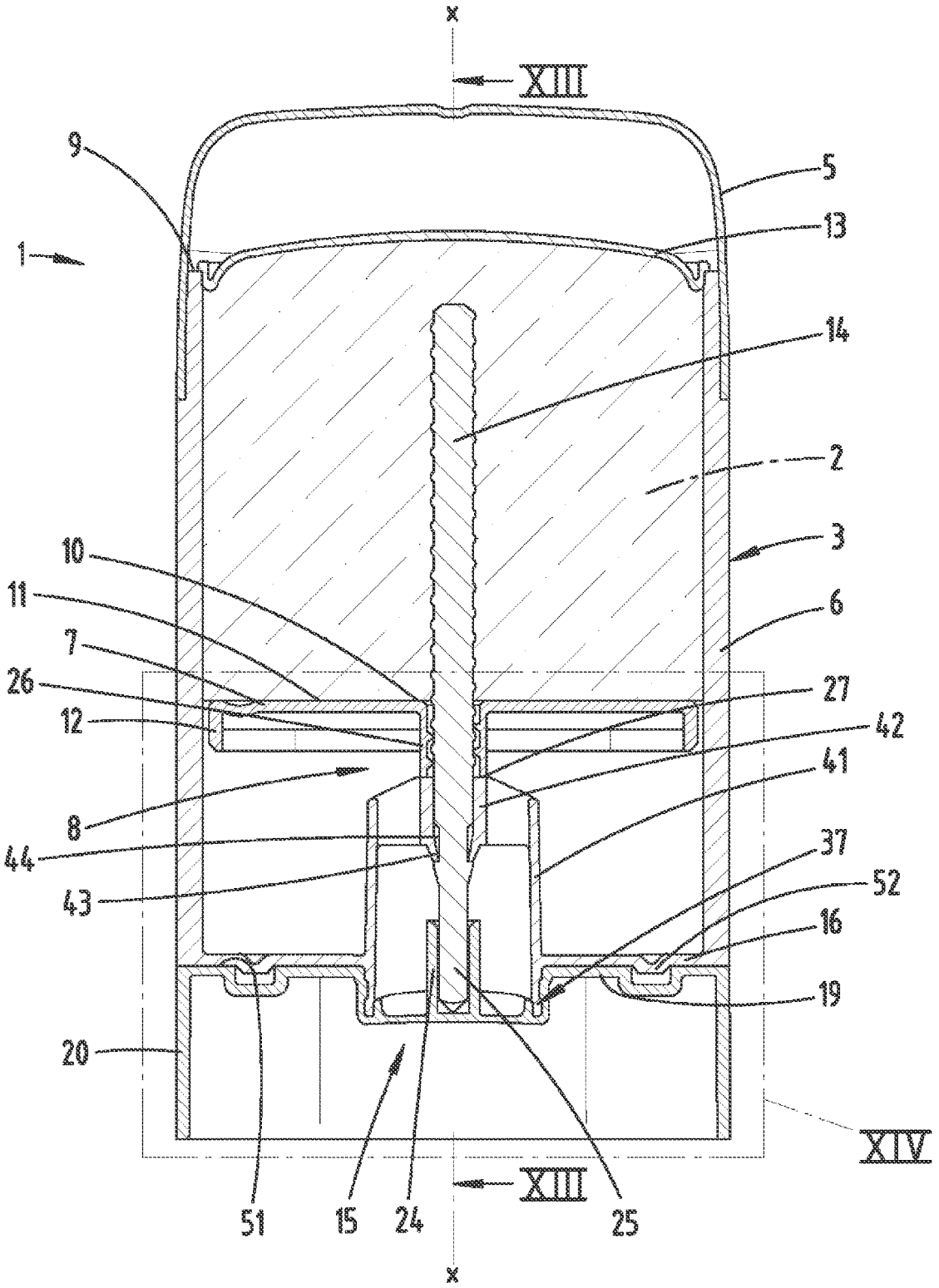
FIG. 12 another sectional view corresponding to FIG. 2, but relating to the device in a third embodiment.
Figure 13:
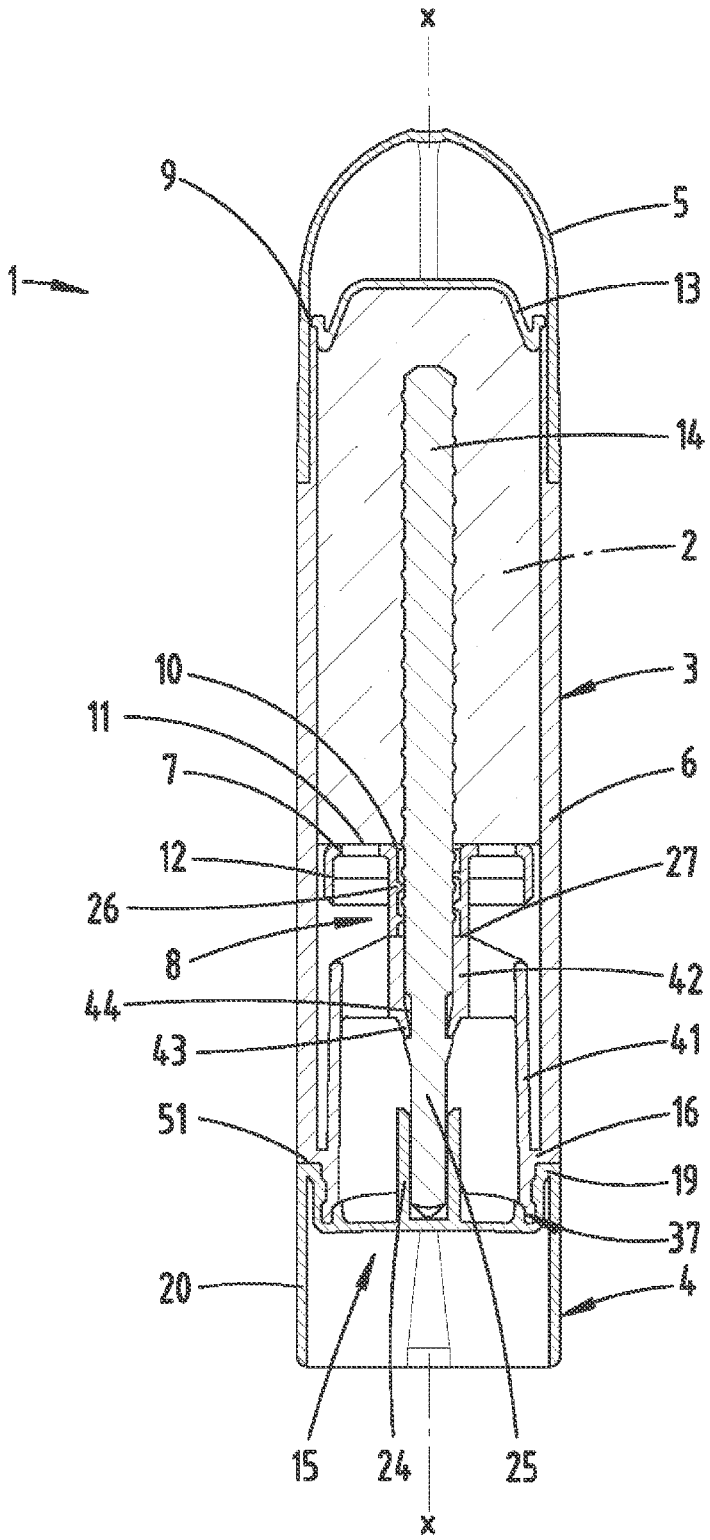
FIG. 13 the section according to line XIII-XIII on FIG. 12.
Figure 14:
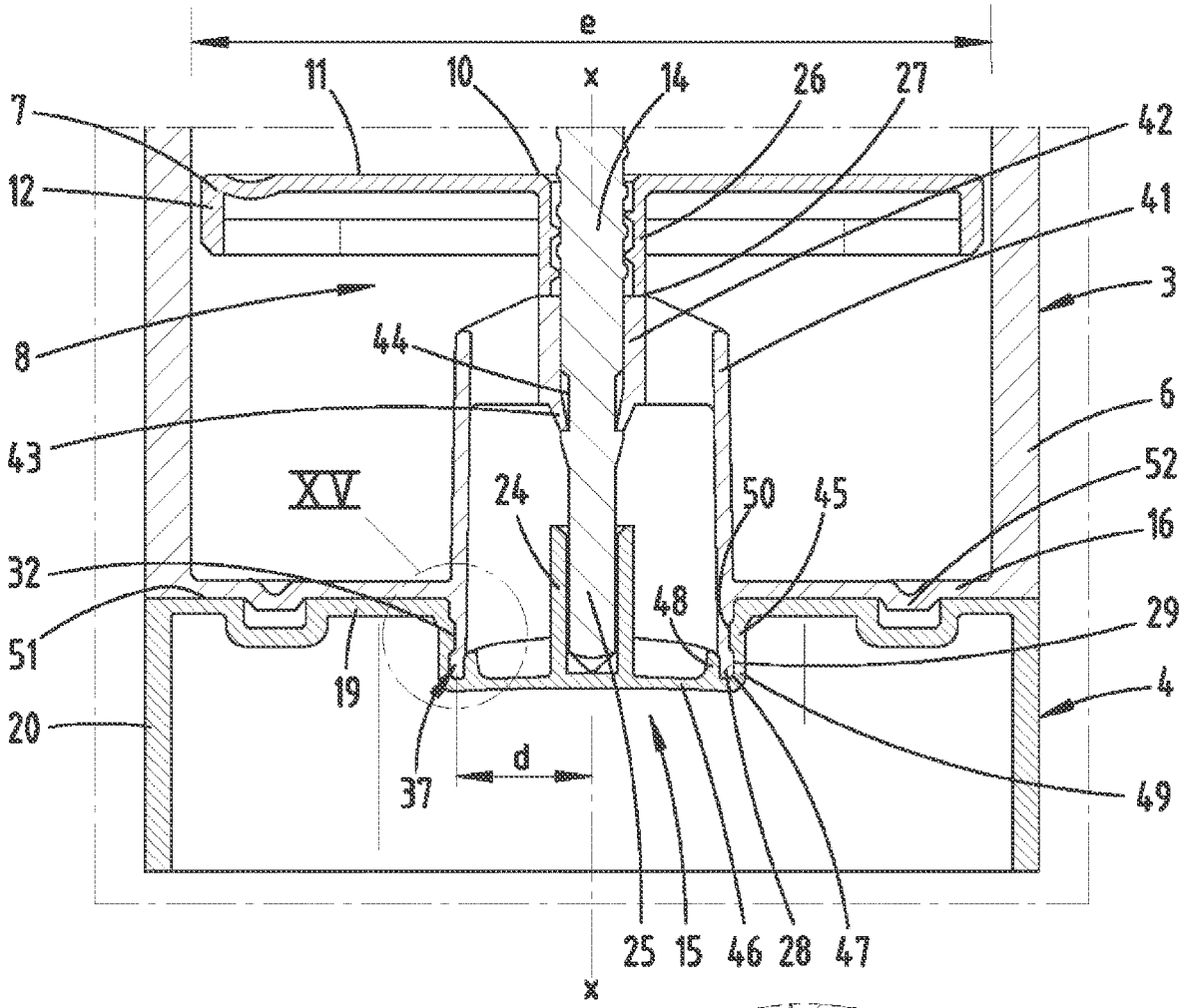
FIG. 14 the magnification of area XIV on FIG. 12.

In particular, the substance 2 can also be spanned in the form of a dome prior to an initial use, for example by a film-like seal 13 (e.g., see the embodiments according to FIGS. 2 and 12). Such a seal 13 can serve as tamper evidence, but beyond that also as a base for filling the device housing 3 with substance 2 in an overhead position while introducing substance 2 into the device housing 3. In addition, such a seal 13 provides an in particular gastight seal to the outside for the space surrounding the substance 2 prior to an initial use.

As an alternative to a seal 13, the cover cap 5 itself can be used for sealing purposes. The cover cap 5 here has a sealing lip 54 that interacts with the interior surface of the housing wall 6 in the area of the housing opening 9 (compare FIGS. 8 and 9).

In particular, the movement unit 8 has a spindle 14 with a spindle axis, which coincides with the longitudinal axis x in the use position of the device 1. The spindle 14 is connected in a rotationally fixed manner with the rotary handle 4 at least in the use position of the device 1, and together with the latter comprises a spindle part 15.

According to the depicted embodiments, the rotary handle 4 can have an adjusted oval layout given a preferably oval layout of the device 1, and is further preferably positioned on the lower face of a housing base 16 aligned transverse to the longitudinal axis x.

According to the embodiments 1 and 2 shown on FIGS. 1 to 11, the rotary handle 4 can form a sleeve 17 concentric to the longitudinal axis x, which passes through the housing base 16 in the area of a central base opening 18 in the direction toward the device interior.

As also preferred, the sleeve 17 can here be designed in an integral and materially uniform manner with a handle cover 19, which surrounds the sleeve 17 and extends radially outward from the latter, transitioning into a handle wall 20 that runs essentially parallel to the longitudinal axis x in a cross section according to FIG. 2 or 8. This correspondingly results in an overall pot-shaped configuration of the rotary handle 4 with a downwardly facing pot opening.

As evident in particular from the sectional views on FIGS. 2 and 3 (first embodiment of the device 1), the sleeve 17 can also extend downwardly beyond the handle cover 19 and into the space surrounded by the handle wall 20, for example over a length viewed in the direction of the longitudinal axis x that can correspond to about one fifth to one third of the height of the handle wall 20 viewed in the same direction.

Figure 10:
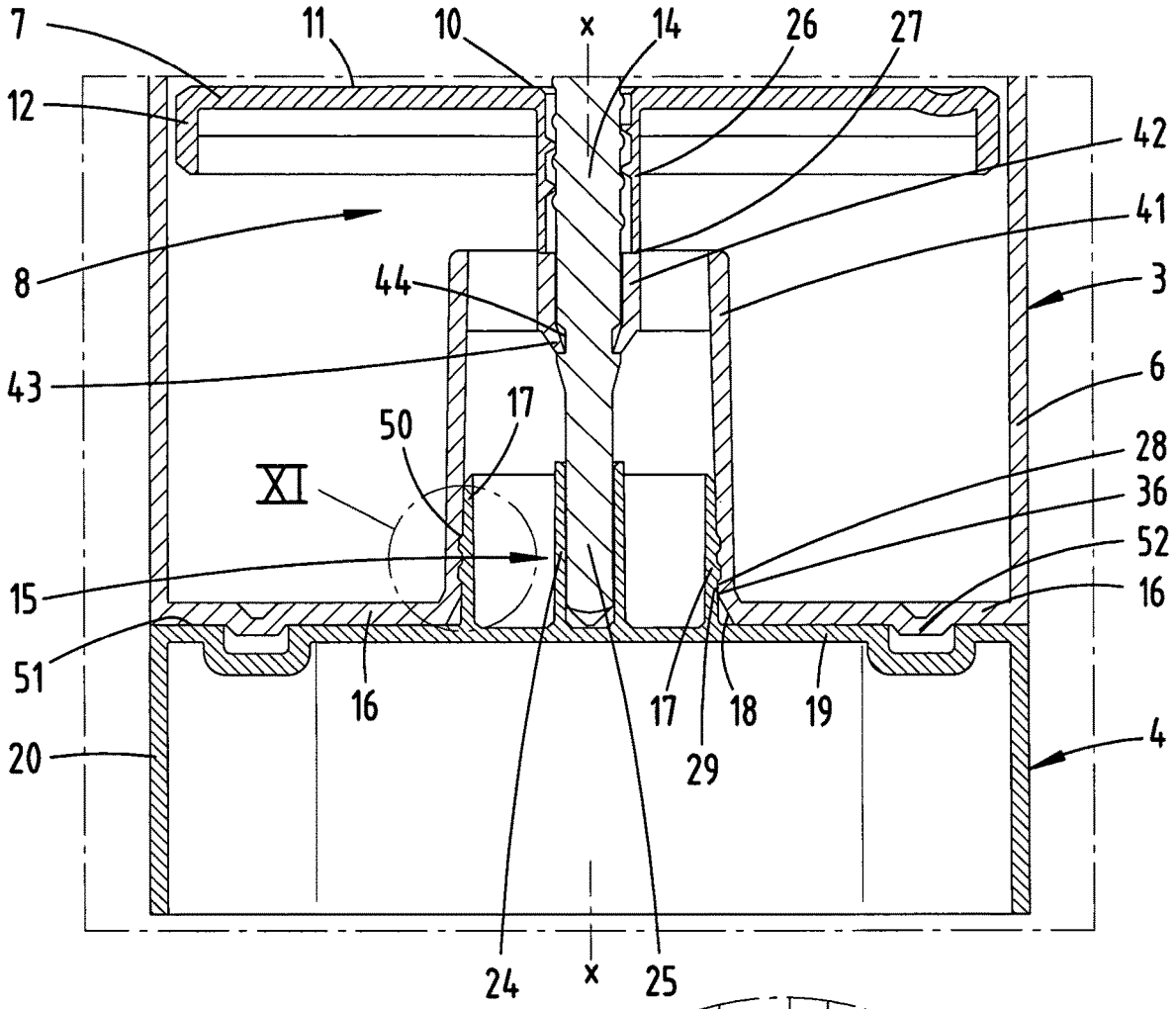
FIG. 10 the magnification of area X on FIG. 8.

The sleeve opening can have a design that is downwardly closed in the direction toward the space surrounded by the handle wall 20, for example directly by the handle cover 19, e.g., according to the embodiment on FIG. 10, or as the result of inserting a separate, for example snap-locked or friction-locked, insertion cap 21.

In the depicted first embodiment (FIGS. 1 to 7), the sleeve 17 transitions in preferably an integral or materially uniform manner into the spindle 14, spaced axially apart from the handle cover 19. The sleeve 17 here forms a spindle base 22 with in particular an enlarged diameter relative to the spindle 14, wherein the foot-side connection of the spindle 14 is further established in particular in the area of a sleeve cover 23 that partially covers the sleeve 17.

In the second embodiment shown on FIGS. 8 to 11, the spindle 14 and the rotary handle 4 have a two-part design. During the assembly of the device 1, these parts are connected with each other in a torsionally rigid manner, in particular by inserting the spindle 14 from above along the longitudinal axis x into a plug-in receptacle 24 of the rotary handle 4 formed concentrically to the longitudinal axis x. The plug-in receptacle 24 is here preferably surrounded at a distance by the sleeve 17.

Figure 16:
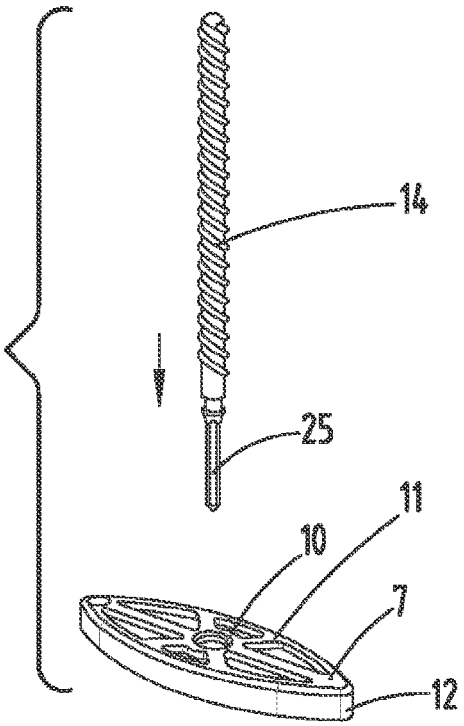
FIG. 16 a perspective view of a spindle and a support of the device according to FIG. 12 in a preassembly position.
Figure 17:
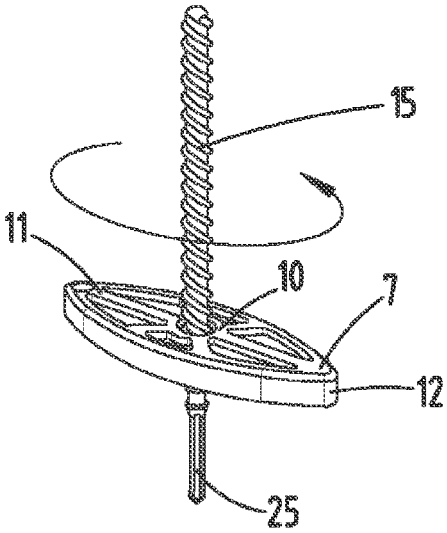
FIG. 17 a view according to FIG. 16, but relating to the assembly position.

The related end area 25 of the spindle 13 is preferably given an unround shape by flat sections in a cross section transverse to the longitudinal axis x (see also FIGS. 16 and 17), so that a torsionally rigid connection can be achieved between the spindle 14 and rotary handle 4 given a corresponding inner geometry of the plug-in receptacle 24.

Independently of the configuration of the spindle part described above, the male thread of the spindle 14 interacts with a female thread of a sleeve part 26. This sleeve part 26 is tightly bound to the support 7, preferably by being formed in an integral and materially uniform manner with the support 7. The spindle 14 and sleeve part 26 form the movement unit 8.

The sleeve part 26 here further preferably extends on the lower face of the surface 11, wherein an end 27 of the sleeve part 26 that faces downward in the use state can define a stop for the lower starting position.

Given a device 1 according to the first exemplary embodiment, this sleeve part end 27 interacts as a limiting stop with the sleeve cover 23 of the integrally designed spindle part 15 (see FIG. 2).

Due to the torsionally rigid guidance of the support 7 along the housing wall 6, rotating the rotary handle 4 around the longitudinal axis x thereby produces a linear movement of the support 7 in the movement direction r.

Figure 5:
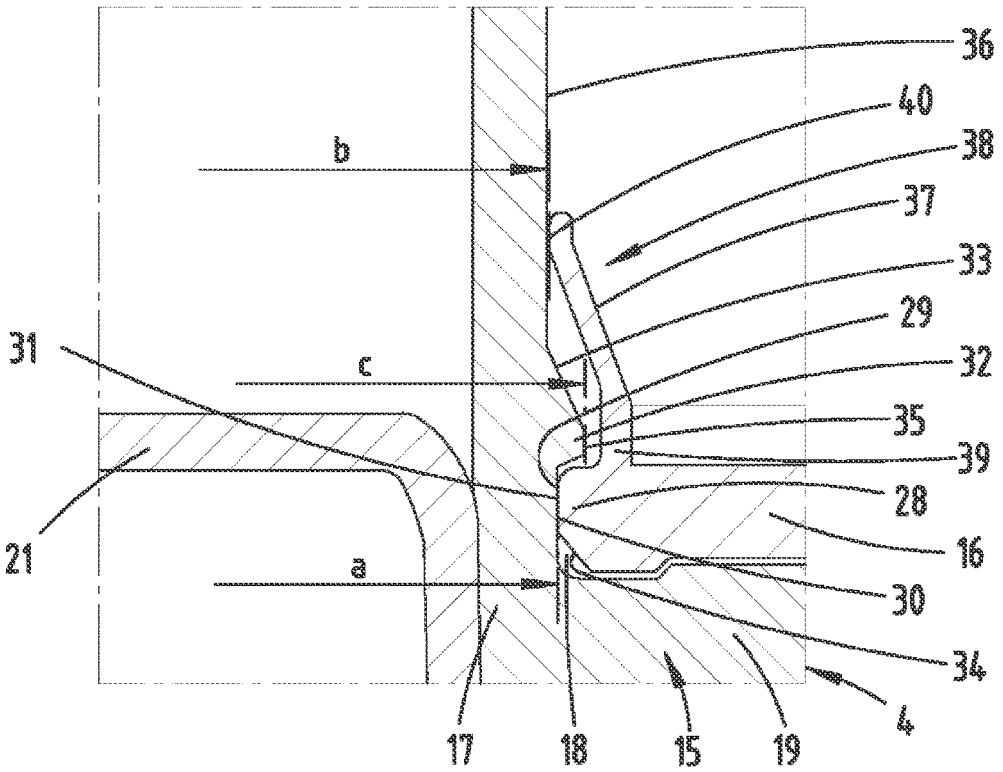
FIG. 5 the magnification of area V on FIG. 4.
Figure 6:
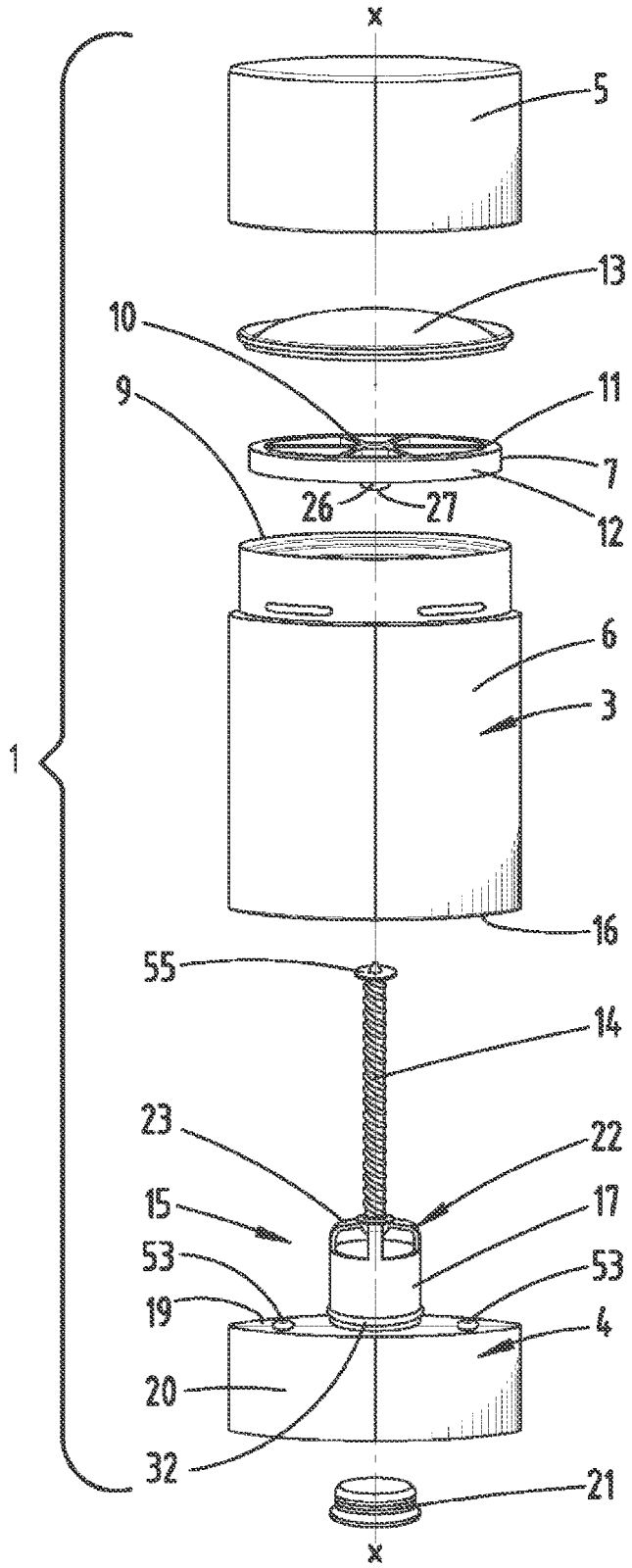
FIG. 6 the device of the first embodiment in a perspective, exploded view.
Figure 7:
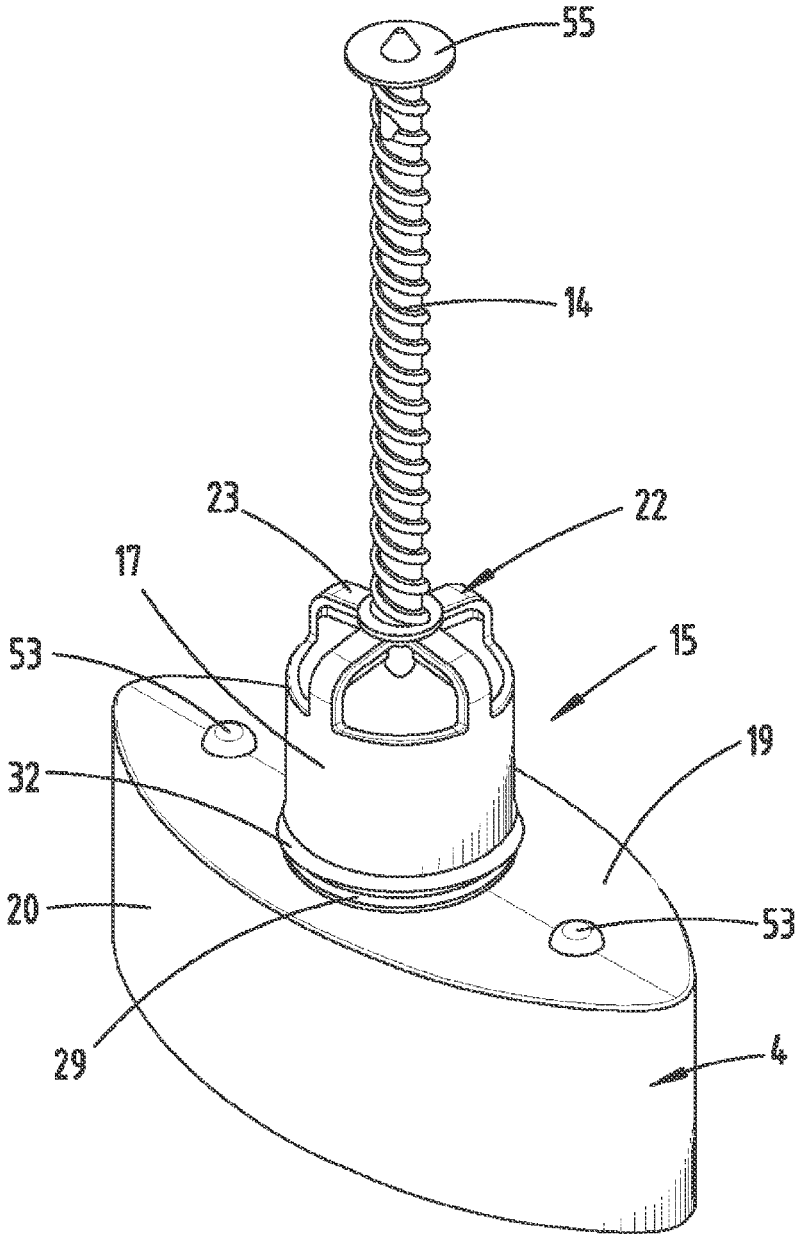
FIG. 7 a spindle part of the device of the first embodiment in a perspective, individual illustration.

The spindle part 15 can here be rotationally guided on the device housing 3 by having a locking protrusion 28 formed in the area of the housing base 16 engage into a locking recess 29 of the spindle part 15 (see in particular magnified view on FIG. 5).

The locking protrusion 28 can here face radially inward and be formed essentially directly on the level of the housing base 16, possibly defining the base opening 18 at the same time. The radially inwardly directed closing surface 30 of the locking protrusion 28 can here form the opening edge, and possibly come to abut against a facing rear surface 31 of the locking recess 29, doing so on a radius a in relation to the longitudinal axis x.

The locking protrusion 28 can be overlapped in an axial direction by a counter-locking protrusion 32 that is circumferentially formed on the outside of the sleeve 17 of the spindle part 15, and conically expands from axially above to axially below, forming a control slant 33. The control slant 33 is used in particular for assembling the spindle part 15 acting together with a counter-control slant 34 on the lower face of the housing-side locking protrusion 28.

The radially outward facing front surface 35 of the counter-locking protrusion 32, e.g., that runs concentrically to the longitudinal axis x, is formed on a radius c, wherein the selected radius c is larger than the radius a of the closing surface 30, for example by the factor of 1.05 to 1.1.

The control slant 33 of the counter-locking protrusion 32 transitions axially upward into a circumferential surface of the spindle part 15 or the sleeve 17 that runs concentrically to the longitudinal axis x. A housing-side seal protrusion 37 abuts against this circumferential surface 36, and in the first exemplary embodiment shown can be designed like a lip in cross section.

The seal protrusion 37 is preferably shaped like a sleeve overall, with a tapering section 38 that results at least partially axially upward in cross section according to FIG. 5, and at least partially runs according to a cone.

As also preferred, the sleeve-shaped seal protrusion 37 can here be molded onto the upper face of the housing base 16, here surrounding the counter-locking protrusion 32 of the spindle part 15 at a distance with a foot section 39 that possibly runs concentrically to the longitudinal axis x. The tapering section 38 extends from this foot section axially upward and bent radially inward, wherein the front surface of the seal protrusion 37 comes to tightly abut with a radially inner seal surface 40 against the circumferential surface 36 of the spindle part 15.

The seal surface 40 is here arranged on a radius b selected to be smaller than the radius a of the closing surface 30 of the locking protrusion 28, and also selected to be smaller than the radius c of the front surface 35 of the counter-locking protrusion 32. For example, the radius b can correspond to about 0.8 to 0.98 times, further for example to about 0.85 to 0.95 times, the radius dimension a.

In addition, the sealing area between the seal protrusion 37 and the circumferential surface 36 of the spindle part 15—viewed from the rotary handle 4—is positioned axially above the lock between the locking protrusion 28 and the locking recess 29, while a possible counter-locking protrusion 32 of the spindle part 15 can be arranged between the seal area and the locking area described above.

In the embodiments on FIGS. 8 to 17, the device housing 3, in particular the device base 16, surrounding its base opening 18, forms a sleeve section 41 in the housing interior that is directed axially upward and concentrically to the longitudinal axis x, as viewed correspondingly from the rotary handle 4. As also preferred, the latter can be designed in an integral and materially uniform manner with the housing base 16, and beyond that with the housing wall 6.

In the second embodiment of the device 1 shown on FIGS. 8 to 11, this sleeve section 41 overlaps the housing base-side sleeve 17 in an axial direction, and forms a guide 42 for the spindle 14 designed concentric to the longitudinal axis x on the lower face spaced axially apart from the plug-in receptacle 24 for the end area 25 of the spindle 14. In the area of the downwardly facing end, the guide 42 engages with radially inwardly directed locking protrusions 43 into a circumferential groove of the spindle 14 forming a locking recess 44.

Figure 11:
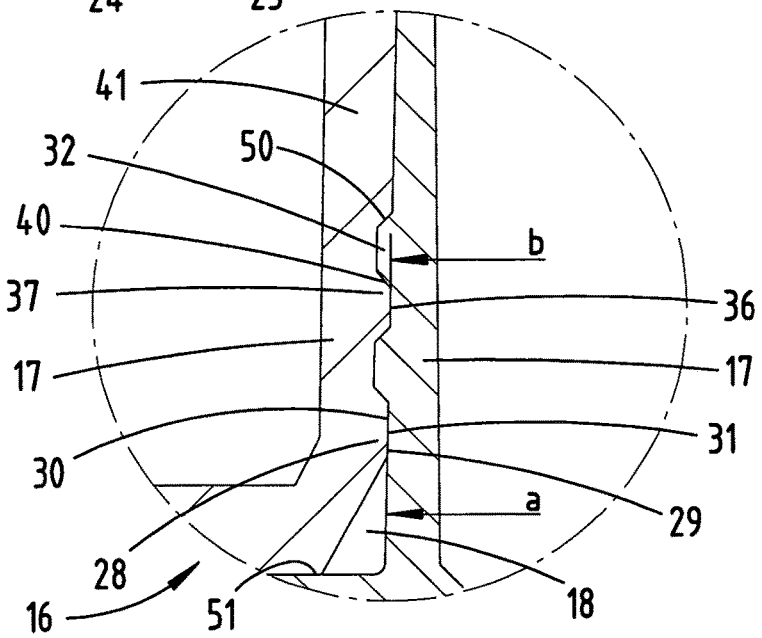
FIG. 11 the magnification of area XI on FIG. 10.

The lock and seal between the rotary handle 4 and the device housing 3, in particular the housing base 16, is achieved in this second embodiment in particular between the housing-side sleeve section 41 and the handle-side sleeve 17 (see in particular magnified view on FIG. 11).

As in the first exemplary embodiment described above, the housing base 16 here as well at the same time essentially forms the base opening 18 circumferentially bordering a locking protrusion 28, which enters into a locking recess 29 of the sleeve 17 allocated on the outside of the wall in an axial direction and in a locking manner.

Viewed from the rotary handle 4, a sealing arrangement is here as well provided axially above this lock, wherein a seal protrusion 37 formed on the wall interior of the sleeve section 41 comes into contact with the circumferential surface 36 with its seal surface 40 in the area of a facing, grooved, circumferential depression of the handle-side sleeve 17.

In this design, the radially inner seal surface 40 of the seal protrusion 37 and the radially inner closing surface 30 of the locking protrusion 28 can lie on a circular line that is concentrically circumferential to the longitudinal axis x and has about the same radius a or b (see FIG. 11).

In the third embodiment shown on FIGS. 12 to 17, the handle cover 19 is centrally lowered like a pot. This yields a circumferential, vertically downwardly directed pot wall 45, which passes over into a pot base 46 directed transverse to the longitudinal axis x. In this embodiment, the plug-in receptacle 24 is formed on the pot base 46 facing into the interior of the sleeve section 41.

The wall of the sleeve section 41 is here formed axially downward further beyond the housing base 16, and here extends inside of the pot-shaped formation of the handle cover 19, essentially radially inwardly flanking the pot wall 45.

Figure 15:
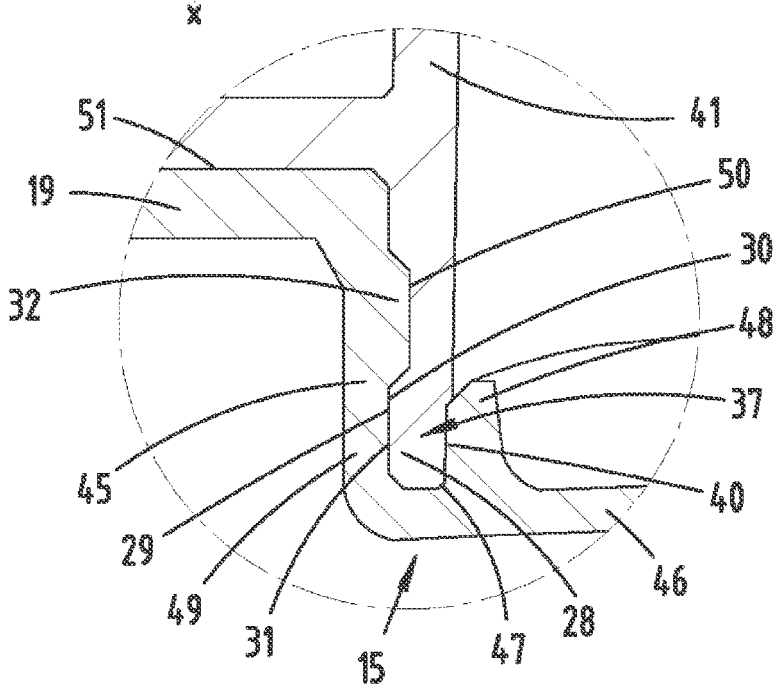
FIG. 15 the magnification of area XV on FIG. 14.

The end of the sleeve section 41 that faces downward in the cross section according to the illustration on FIG. 15 forms the seal protrusion 37, wherein the downwardly free seal edge 47 of the seal protrusion 37 that here results is in this cross section preferably tightly surrounded by the spindle part 15 in a U-shaped manner, here in particular the pot-shaped configuration of the rotary handle 4.

As evident in particular from the magnified view on FIG. 15, the seal protrusion 37 is both radially inwardly and radially outwardly flanked by a respective U-leg 48, 49, as well as underpinned on the lower face by the pot base 46 that connects the U-legs in a web-like manner. The radially outer U-leg 49 is preferably formed by the pot wall 45. As with the pot wall 45, the radially inner U-leg 48 extends concentrically to the longitudinal axis x, but does so over a height viewed in the axial direction that can correspond to about 0.4 to 0.6 times the height of the pot wall 45. In particular this radially inner U-leg 48 interacts in a sealing manner with the sleeve section 41, in particular with the end-side seal protrusion 37 and the seal edge 47. Furthermore, there can additionally or even alternatively thereto be a seal between the seal edge 47 and the radially outer U-leg 49 and/or the U-web formed by the pot base 46.

The seal edge 47 that interacts in particular with the U-leg 48 here preferably runs on a radius d, which can correspond to about one eighth to one fifth of the largest inner diameter e of the device housing 3 in the longitudinal extension direction L.

The radially outer U-leg 49 or the pot wall 45 can here at the same time form an inwardly facing locking recess 29 for engaging a radial expansion of the seal protrusion 37. This radial expansion acts as a locking protrusion 28.

Viewed proceeding from the rotary handle 4, a radially inwardly protruding counter-locking protrusion 32 can be formed axially above the inner U-leg 48 on the spindle part 15, in particular on the pot wall 45 of the rotary handle 4, and engage into a corresponding counter-locking recess 50 of the sleeve section 41. Viewed in an axial direction, this counter-locking recess 50 is correspondingly positioned between the foot-side sealing zone of the sleeve section 41 and the lock preferably likewise provided in this area and the housing base 16 or the handle cover 19.

Given a preferably unround layout of the device 1 and corresponding unround layout of the rotary handle 4, rotational base positions of the rotary handle 4 can be preferred, in which the rotary handle 4 essentially overlaps the allocated device housing 3 in the direction of the longitudinal axis x. In the case of an oval layout configuration of the kind also shown, two rotational base positions of the rotary handle 4 can thus arise. As further preferred, the latter can be defined by an overrunable lock. For this purpose, sections of an undersurface 51 of the housing base 16 facing the handle cover 19 of the rotary handle 4 can have a locking formation 52 in the form of an elevation, which in one of the rotational base positions of the rotary handle 4 can fall into a preferably form-fitting counter-locking formation 53 in the form of a cup-shaped depression in the area of the handle cover 19.

In the exemplary embodiments shown, circularly circumferential areas relative to the longitudinal axis x preferably arise both radially inward and radially outward from the locking formations 52 or the counter-locking formations 53, wherein the housing base 16 or the undersurface 51 of the housing base 16 can supportively abut directly against the rotary handle 4 or its cover 19 in these areas.

Two such locking formations 52 and counter-locking formations 53 lying essentially diametrically opposite each other can be provided.

The lock produced by the locking formation 52 engaging into the counter-locking formation 53 can be overrun in the easiest manner by deliberately rotating the rotary handle 4.

| Reference List | |
|---|---|
| 1 | Device |
| 2 | Substance |
| 3 | Device housing |
| 4 | Rotary handle |
| 5 | Cover cap |
| 6 | Housing wall |
| 7 | Support |
| 8 | Movement unit |
| 9 | Housing opening |
| 10 | Central area |
| 11 | Surface |
| 12 | Wall |
| 13 | Seal |
| 14 | Spindle |
| 15 | Spindle part |
| 16 | Housing base |
| 17 | Sleeve |
| 18 | Base opening |
| 19 | Handle cover |
| 20 | Handle wall |
| 21 | Insertion cap |
| 22 | Spindle base |
| 23 | Sleeve cover |
| 24 | Plug-in receptacle |
| 25 | End area |
| 26 | Sleeve part |
| 27 | End |
| 28 | Locking protrusion |
| 29 | Locking recess |
| 30 | Closing surface |
| 31 | Rear surface |
| 32 | Counter-locking protrusion |
| 33 | Control slant |

-continued

| Reference List | |
|---|---|
| 34 | Counter-control slant |
| 35 | Front surface |
| 36 | Circumferential surface |
| 37 | Seal protrusion |
| 38 | Tapering section |
| 39 | Foot section |
| 40 | Seal surface |
| 41 | Sleeve section |
| 42 | Guide |
| 43 | Locking protrusion |
| 44 | Locking recess |
| 45 | Pot wall |
| 46 | Pot base |
| 47 | Seal edge |
| 48 | U-leg |
| 49 | U-leg |
| 50 | Counter-locking recess |
| 51 | Undersurface |
| 52 | Locking formation |
| 53 | Counter-locking formation |
| 54 | Sealing lip |
| 55 | Stop |
| a | Radius |
| b | Radius |
| c | Radius |
| d | Radius |
| e | Radius |
| r | Movement direction |
| x | Rotational axis |
| L | Longitudinal extension direction |
| S | Narrow extension direction |

The invention claimed is:

1. A device (1) for discharging a substance (2), comprising:

a device housing (3), a movable support (7) arranged in the device housing (3) and being configured to act on the substance (2), a rotary handle (4) configured to move the support (7) between a lower starting position and an upper extended position of the support (7), the rotary handle (4) forming a spindle part (15) together with a spindle (14) that is configured to be rotated around a longitudinal axis (x) provided in a movement direction of the support (7), wherein the spindle part (15) passes through a housing base (16), and is locked and sealed to the housing base (16), wherein a locking protrusion (28) of the housing base (16) further engages into a locking recess (29) of the spindle part (15), and a seal protrusion (37) running from the housing base (16) abuts tightly against a circumferential surface (36) of the spindle part (15), wherein the rotary handle (4) of the spindle part (15) is additionally formed on a lower face of the device housing (3), wherein, viewed from the rotary handle (4), the locking recess (29) of the spindle part (15) is formed axially below a circumferential surface (36) that interacts with the seal protrusion (37), wherein the seal protrusion (37) is in the form of a sleeve, with an at least partially conical taper (38) that arises at least partially axially upwardly in cross section, wherein a counter-locking protrusion (32) is formed on the spindle part (15), and conically expands from axially above to axially below in cross section, wherein a control slant (33) of the counter-locking protrusion (32) further transitions axially upward into a circumferential surface (36) of the spindle part (15) or the sleeve (17) that runs concentrically to the longitudinal axis x, wherein the seal protrusion (37) abuts against this circumferential surface (36), which is molded onto the upper face of the housing base, and surrounds the counter-locking protrusion (32) of the spindle part (15) with a foot section (39) that runs concentrically to the longitudinal axis x, wherein a radially outer facing front surface (35) of the counter-locking protrusion (32) is formed on a radius (c), which is selected to be larger than a radius (a) of an inwardly directed closing surface (30) of the locking protrusion (28), wherein the foot section (39) surrounds the counter-locking protrusion (32) at a distance, wherein the tapering section (38) extends from the foot section and bends axially upward and radially inward, wherein a radially inner seal surface (40) of the seal protrusion (37) comes to tightly abut against the circumferential surface (36) of the spindle part on an end side of the tapering section (38), wherein the seal protrusion (37) is designed as a lip in cross section, and wherein the radially inner seal surface (40) is arranged on a radius (b) that is selected to be smaller than a radius (a) of the closing surface (30) of the locking protrusion (28), which radius (b) is also smaller than a radius (c) of the front surface (35) of the counter-locking protrusion (32).

2. The device according to claim 1, wherein the locking protrusion (28) has a radially inner closing surface (30) and the seal protrusion (37) has a radially inner seal surface (40), and wherein the seal surface (40) is formed on the same or a smaller radius (b) as the closing surface (30).

3. The device according to claim 1, wherein the rotary handle (4) interacts with the housing base (16) in a locking, yet overrunable, manner so as to maintain a stable rotational position.

4. A device (1) for discharging a substance (2), comprising:

a device housing (3), a movable support (7) arranged in the device housing (3) and being configured to act on the substance (2), a rotary handle (4) configured to move the support (7) between a lower starting position and an upper extended position of the support (7), the rotary handle forming a spindle part (15) together with a spindle (14) that can be rotated around a longitudinal axis (x) provided in a movement direction of the support (7), wherein the spindle part (15) passes through a housing base (16), and is locked and sealed to the housing base (16), wherein a locking protrusion (28) of the housing base (16) further engages into a locking recess (29) of the spindle part (15), and a seal protrusion (37) running from the housing base (16) abuts tightly against a circumferential surface (36) of the spindle part (15), wherein the rotary handle (4) of the spindle part (15) is additionally formed on a lower face of the device housing (3), wherein, viewed from the rotary handle (4), the locking recess (29) of the spindle part (15) is formed axially below a circumferential surface (36) that interacts with the seal protrusion (37), wherein the spindle (14) and the rotary handle (4) have a two-part design, and, during the assembly of the device (1), are connected with each other in a torsionally rigid manner, wherein the housing base (16), surrounding a base opening (18) formed in the housing base, forms a sleeve section (41) in a housing interior that is directed axially upward and concentrically to the longitudinal axis x, as viewed correspondingly from the rotary handle (4), wherein the sleeve section (41) overlaps a housing base-side sleeve (17) in an axial direction, and forms a guide (42) for the spindle (14) designed concentric to the longitudinal axis x on a lower face and spaced axially part from a plug-in receptacle (24) for an end area (25) of the spindle, and wherein the guide (42) engages with radially inwardly directed locking protrusions (43) into a circumferential groove of the spindle (14) forming a locking recess (44) in an area of a downwardly facing end of the guide (42).

5. A device (1) for discharging a substance (2), comprising:

a device housing (3):

a movable support (7) arranged in a device housing (3) and being configured to act on the substance (2), a rotary handle (4) configured to move the support (7) between a lower starting position and an upper extended position of the support (7), the rotary handle forming a spindle part (15) together with a spindle (14) that is configured to be rotated around a longitudinal axis (x) provided in a movement direction of the support (7), wherein the spindle part (15) passes through a housing base (16), and is locked and sealed to the housing base (16), wherein a locking protrusion (28) of the housing base (16) further engages into a locking recess (29) of the spindle part (15), and a seal protrusion (37) running from the housing base (16) abuts tightly against a circumferential surface (36) of the spindle part (15), wherein the rotary handle (4) of the spindle part (15) is additionally formed on a lower face of the device housing (3), wherein the seal protrusion (37) is formed on a sleeve section (41) of the device housing (3), wherein a seal edge (47) of the sleeve section (41) that is free on the lower face is tightly surrounded by the spindle part (15) on an interior in a U-shaped manner, wherein the interior of the spindle part forming the U-shape has two U-legs (48, 49), of which one U-leg (48) runs radially inward to the seal edge (47), and the other U-leg (49) runs radially outward to the seal edge (47), and wherein the radially outer running U-leg (49) forms a locking recess (29).

6. The device according to claim 5, wherein the seal edge (47) of the sleeve section (41) runs on a radius (d) that corresponds to one third or less of a largest inner diameter (e) of the device housing (3).

7. The device according to claim 5, wherein the spindle part (15) integrally forms a lower floor that covers an entire lower surface.

8. The device according to claim 5, wherein the spindle part (15) has a counter-locking protrusion (32), which is formed axially above the radially inner U-leg (48) of the enclosure.

9. The device according to claim 5, wherein the rotary handle (4) and the spindle (15) are designed separately.

10. The device according to claim 9, wherein the housing base (16) has an undersurface (51), and wherein an undersurface (51) of the housing base (16) has one or several locking formations (52), which interact with one or several counter-locking formations (53) of the rotary handle (4), and wherein a circularly circumferential area is provided at least radially inside of one of the locking formations (52), in which the housing base (16) and the rotary handle (4) directly abut against each other.

11. The device according to claim 10, wherein a circularly circumferential area is provided radially outside of the one locking formation (52), in which the housing base (16) and the rotary handle (4) directly abut against each other.

12. The device according to claim 11, wherein two locking formations (52) are provided on the undersurface (51) of the housing base (16), and two counter-locking formations (53) are provided on the handle (4).

13. The device according to claim 12, wherein the locking formations (52) as well as the counter-locking formations (53) are each arranged diametrically opposite each other in relation to the longitudinal axis (x).

* * * * *